US008261810B1

(12) United States Patent
Liang

(10) Patent No.: US 8,261,810 B1
(45) Date of Patent: Sep. 11, 2012

(54) TURBINE AIRFOIL CERAMIC CORE WITH STRAIN RELIEF SLOT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/357,479

(22) Filed: Jan. 24, 2012

(51) Int. Cl.
*B22C 9/10* (2006.01)

(52) U.S. Cl. ..... 164/369; 164/122.1; 164/122.2

(58) Field of Classification Search ..... 164/122.1, 164/122.2, 369, 370, 397
See application file for complete search history.

(56) References Cited

U.S. PATENT DOCUMENTS 5,599,166 A * 2/1997 Deptowicz et al. ..... 416/97 R
5,947,181 A 9/1999 Davis
7,780,414 B1 8/2010 Liang

* cited by examiner

*Primary Examiner* — Jessica L Ward
*Assistant Examiner* — Kevin E Yoon
(74) *Attorney, Agent, or Firm* — John Ryznic

(57) ABSTRACT

A ceramic core used for cast an air cooled turbine rotor blade or stator vane for a gas turbine engine, the ceramic core includes a larger ceramic core piece connected to a smaller ceramic core piece with a number of even smaller cross-over hole forming pieces connecting the larger piece to the smaller piece, and a strain relief slot formed in the larger ceramic core piece adjacent to the cross-over hole forming pieces that prevent the smaller cross-over hole pieces from breaking during the casting process from relative movement of the larger ceramic core piece with respect to the smaller ceramic core piece. The strain relief slot can be used to cast a rotor blade or a stator vane.

12 Claims, 9 Drawing Sheets

TURBINE AIRFOIL CERAMIC CORE WITH STRAIN RELIEF SLOT

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a ceramic core used to cast a turbine rotor blade using an investment casting process.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The turbine stator vanes and rotor blades in the first and even the second stages must include internal cooling circuits in order to withstand the higher gas stream temperatures passing through these stages in the turbine. Complex shaped internal cooling passages and features have been proposed that will increase the cooling effectiveness of the cooling air flow using a minimum amount of cooling air. A combination of convection cooling, impingement cooling and film cooling are used to provide adequate cooling for the airfoils and control the metal temperature to prevent hot spots.

Air cooled turbine vanes and blades are formed using a ceramic core having the shape of the internal cooling air passages and features over which the metal airfoils are cast. The cooling passages within the airfoil typically include a multiple pass serpentine flow cooling circuit in which 180 degree turns connected adjacent legs of the serpentine circuit. These 180 degree turns are located adjacent to the blade tip and the platform. The ceramic core turns at the tip are well supported within the mold outside of the airfoil. However, the turns at the platform end are generally supported by cross-ties or small conical geometry, which attach at one end to the platform turns and at the opposite end to the coolant supply or exit passages in the turbine vane shank or blade root. The ceramic core is essentially a solid body which is shaped to conform to the complex interior coolant passages of the blade or vane. This is described in U.S. Pat. No. 5,947,181 issued to Davis on Sep. 7, 1999 and entitled COMPOSITE, INTERNAL REINFORCED CERAMIC CORES AND RELATED METHODS.

U.S. Pat. No. 7,780,414 issued to Liang on Aug. 24, 2010 and entitled TURBINE BLADE WITH MULTIPLE METERING TRAILING EDGE COOLING HOLES discloses a turbine rotor blade formed from a ceramic core where the ceramic core is used to make a first or second stage turbine blade in an industrial gas turbine engine. The ceramic core includes a serpentine flow forming pierce with a trailing edge cooling supply channel forming piece on the trailing edge end. Three rows of metering holes are formed by a core piece in which a continuous flow channel piece on the tip portion and the root portion of the blade support the core piece that forms the metering holes and impingement cavity pieces such that the ceramic core is rigid and strong to prevent shear force and local bending of the core during casting will not break the core. A first and a second stage turbine blade is formed from the ceramic core and includes a forward flowing serpentine flow circuit for the first stage blade with the first channel of the serpentine flow circuit forming the trailing edge supply channel. A second stage blade includes an aft flowing serpentine flow circuit with the last channel forming the trailing edge supply channel. The three rows of metering holes allow for a gradual pressure drop from the high pressure trailing edge cooling supply channel and out the discharge holes or ducts along the edge of the blade.

FIGS. 1 through 3 show the cooling configurations and associated ceramic cores used to cast the blade for the U.S. Pat. No. 7,780,414 described above. These ceramic cores have been in production for the past 6 years. Core breakage for the first stage blade (shown in FIG. 1) occur at the lower span of the leading impingement cross-over hole 11 and the trailing edge first impingement cross-over hole 12. Ceramic core break for the second stage blade occur at the same generally area as in the first stage blade. FIG. 2 shows a ceramic core for a first or second stage rotor blade with the locations of the core breaks 13 and 14. FIG. 3 shows a second stage blade ceramic core with the locations of the core breaks 15 and 16.

The applicant has discovered that this common ceramic core breakage issue is due to a mismatch of the ceramic core geometry. The airfoil ceramic core 17 is much larger than the ceramic core used to form the impingement pocket 18 with the cross-over hole 19 connecting the two together. FIG. 4 shows one arrangement with the larger core 17 aligned with the smaller core 18 while FIG. 5 shows the two cores at an angle. The ceramic cores 17 and 18 are not inline to each other in either of the spanwise direction or the streamwise direction. During the casting process, the large ceramic core 17 will yield a different movement than the smaller ceramic core 18 used for the impingement pocket and thus induce a load to the ceramic core on the cross-over hole 19. In other words, the ceramic core will bend during the casting process such that some of the cross-over holes 19 will break. Since the ceramic core for the cross-over hole 19 is a smaller size relative to the larger ceramic core for the cooling passages 17 or the impingement cavity 18, core breakage at the cross-over hole 19 location will occur due to this uneven loading. Ceramic core breakage during the casting process results in defective cooling air passages or features in the solid metal blade and thus defective or unusable blades. Low casting yields due to defective casts result in much higher production costs for the blades.

BRIEF SUMMARY OF THE INVENTION

A ceramic core that is sued to cast an air cooled turbine rotor blade or stator vane, where the ceramic core includes a larger ceramic core piece connected to a smaller ceramic core piece through a number of cross-over hole forming pieces. The larger ceramic core piece includes a strain relief slot formed adjacent to the cross-over holes that would be broken during the casting process due to relative bending between the larger core piece and the smaller core piece.

In a rotor blade, two strain relief slots are used in which one extends along the blade root and into the cooling air supply channel along the leading edge region of the blade. The second strain relief slot is located in the cooling air supply channel adjacent to the trailing edge region of the blade.

In the stator vane ceramic core, one strain relief slot is used and it extends into the leading edge cooling air channel from the outer diameter endwall of the vane to provide strain relief along the cross-over holes in this section of the vane forming ceramic core.

DETAILED DESCRIPTION OF THE INVENTION

The present invention is a ceramic core used to form a first or second stage rotor blade for a turbine in an industrial gas turbine engine, where the ceramic core includes a strain release slot formed in the larger section of the ceramic core which will function to break down the larger ceramic core section and form a smaller ceramic core tie with the smaller ceramic core section for the impingement pocket that will reduce the relative movement between the larger core section and the smaller core section. This method and apparatus can also be applied to ceramic cores used to form stator vanes that have a high degree of spanwise bow and large first pass serpentine flow circuits.

Figure 1:
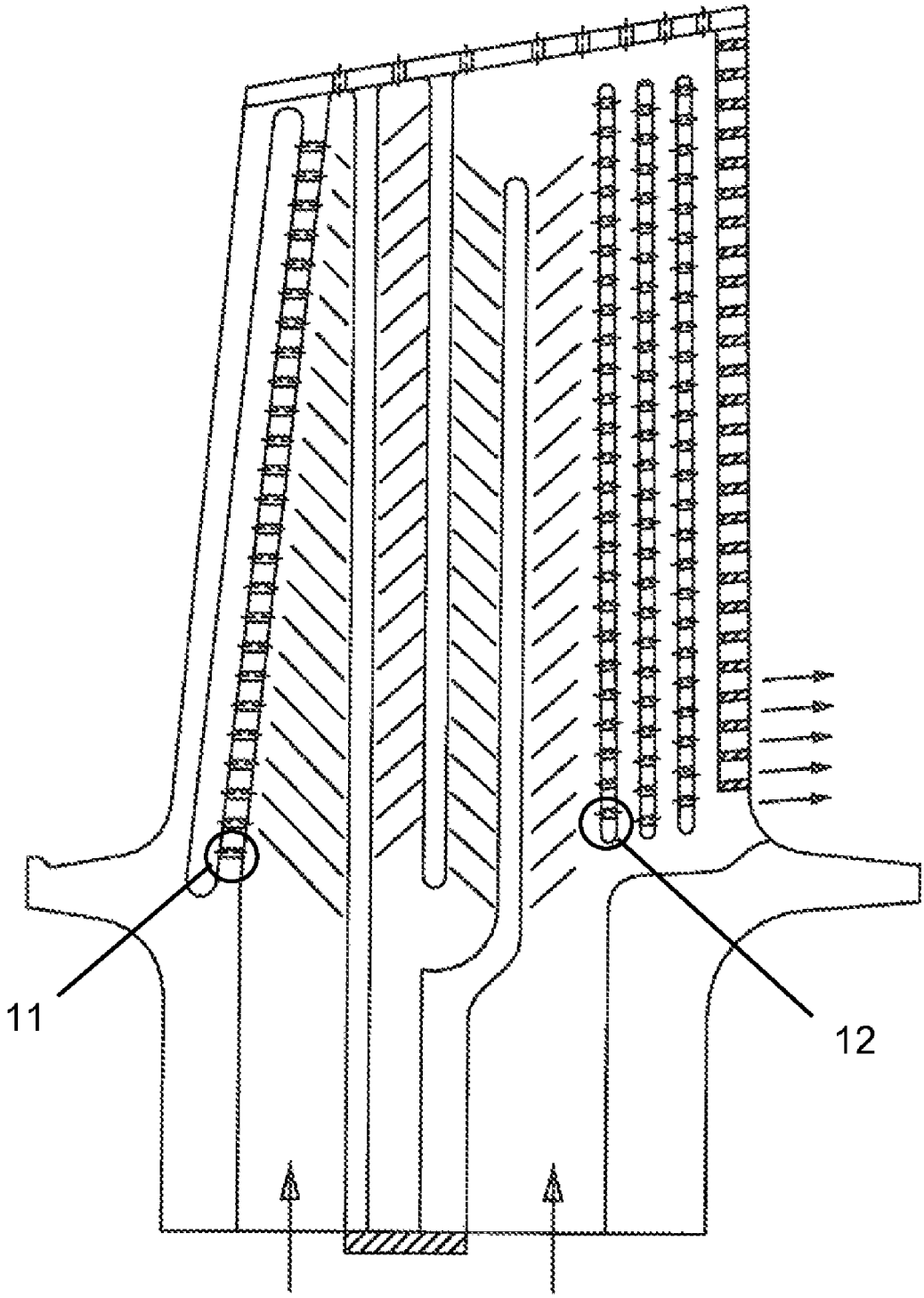
FIG 1 Prior Art
FIG. 1 shows a cross section side view of the prior art Liang first stage blade cooling circuit with the core breakage locations in the leading edge region and the trailing edge region near to the platform.
Figure 2:
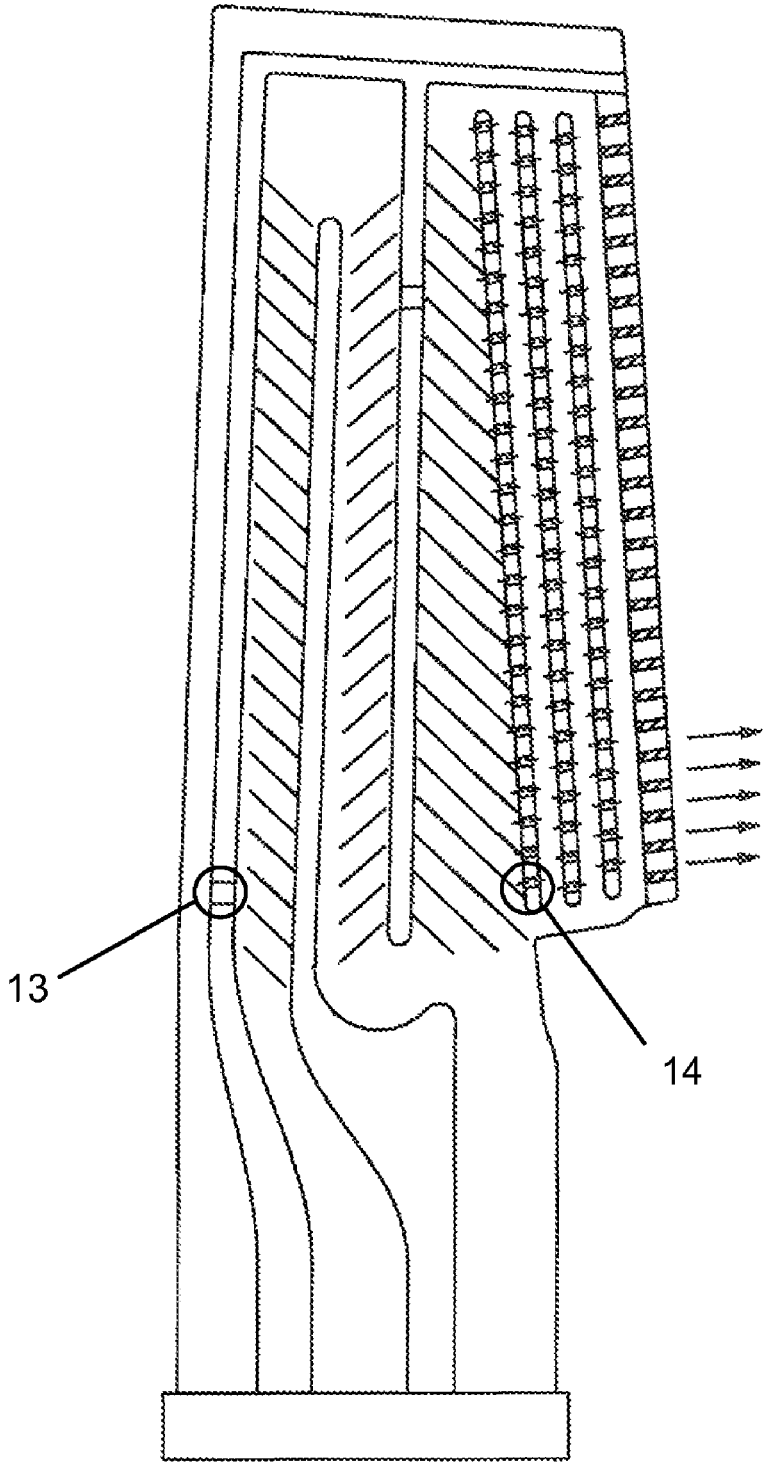
FIG 2 Prior Art
FIG. 2 shows a cross section side view of a ceramic core used to form the first or second stage turbine blade of the prior art Liang patent.
Figure 3:
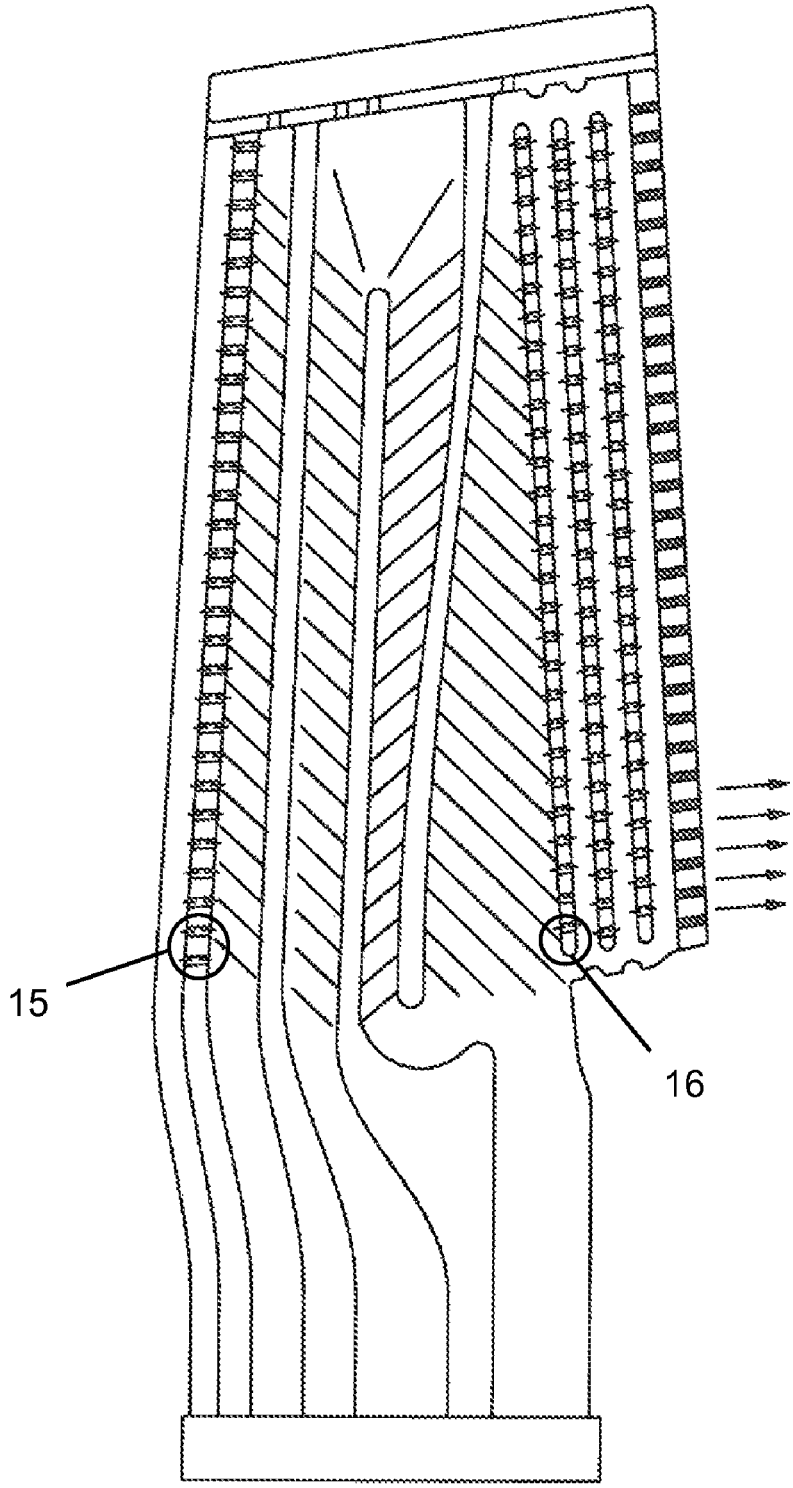
FIG 3 Prior Art
FIG. 3 shows a ceramic core used to form the second stage blade in the prior art Liang patent.
Figure 4:
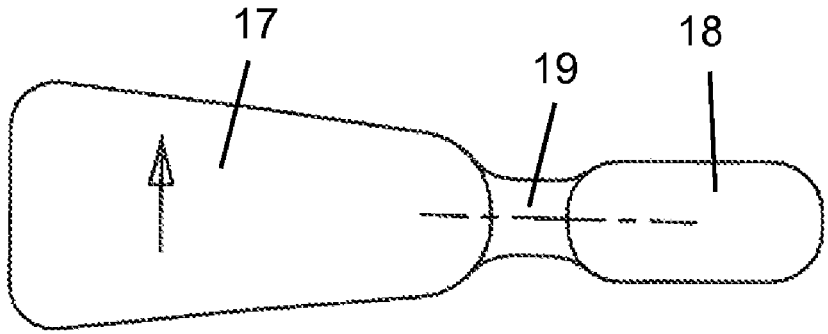
FIG 4 Prior Art
FIG. 4 shows a ceramic core at the blade root section of the prior art Liang patent with a larger core for the serpentine cooling passage connected to the smaller impingement pocket through an even smaller cross-over hole all formed at an inline angle.
Figure 5:
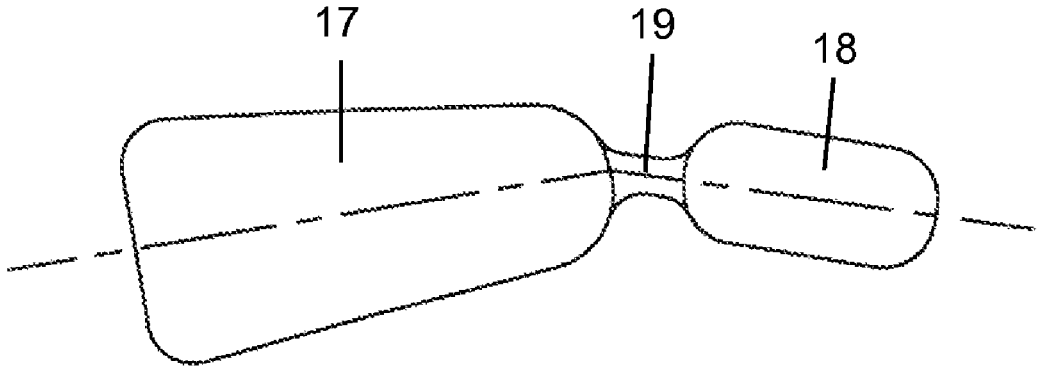
FIG 5 Prior Art
FIG. 5 shows the FIG. 4 ceramic core but with the larger ceramic core at an angle to the smaller impingement pocket core.
Figure 6:
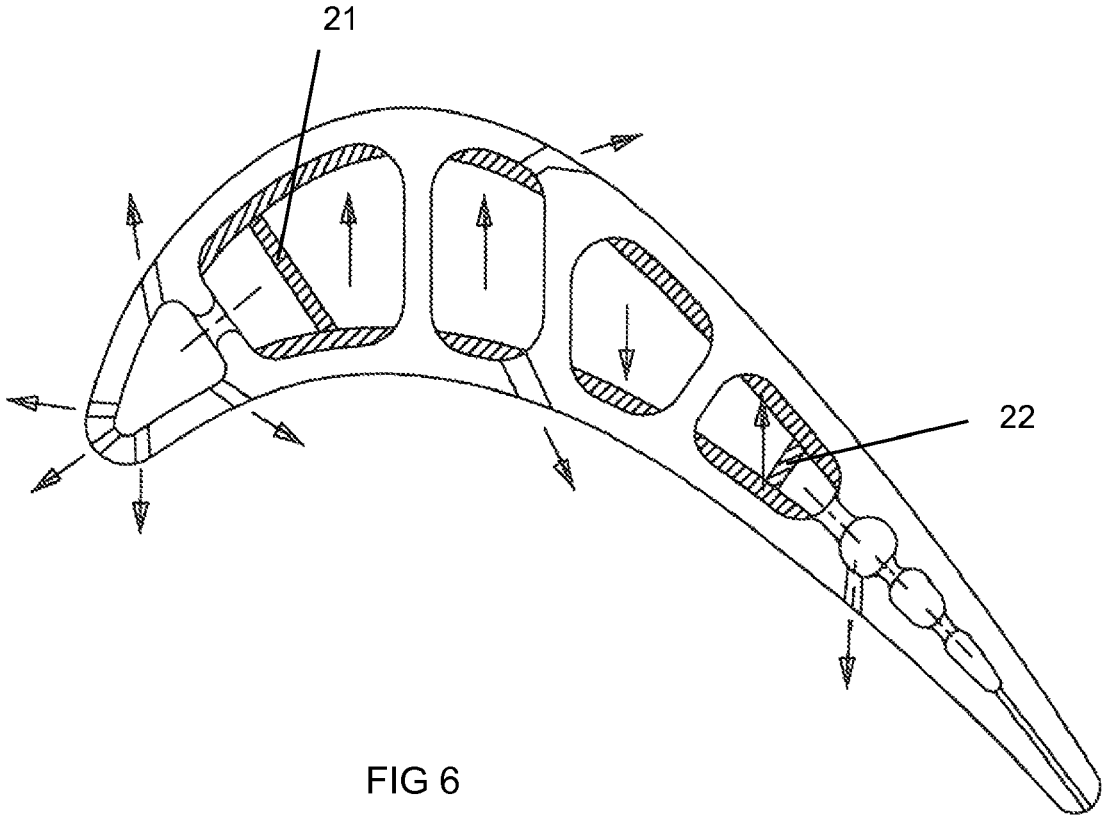
FIG. 6 shows a cross section top view of a first stage blade with the strain relief ribs formed from the ceramic core of the present invention.
Figure 7:
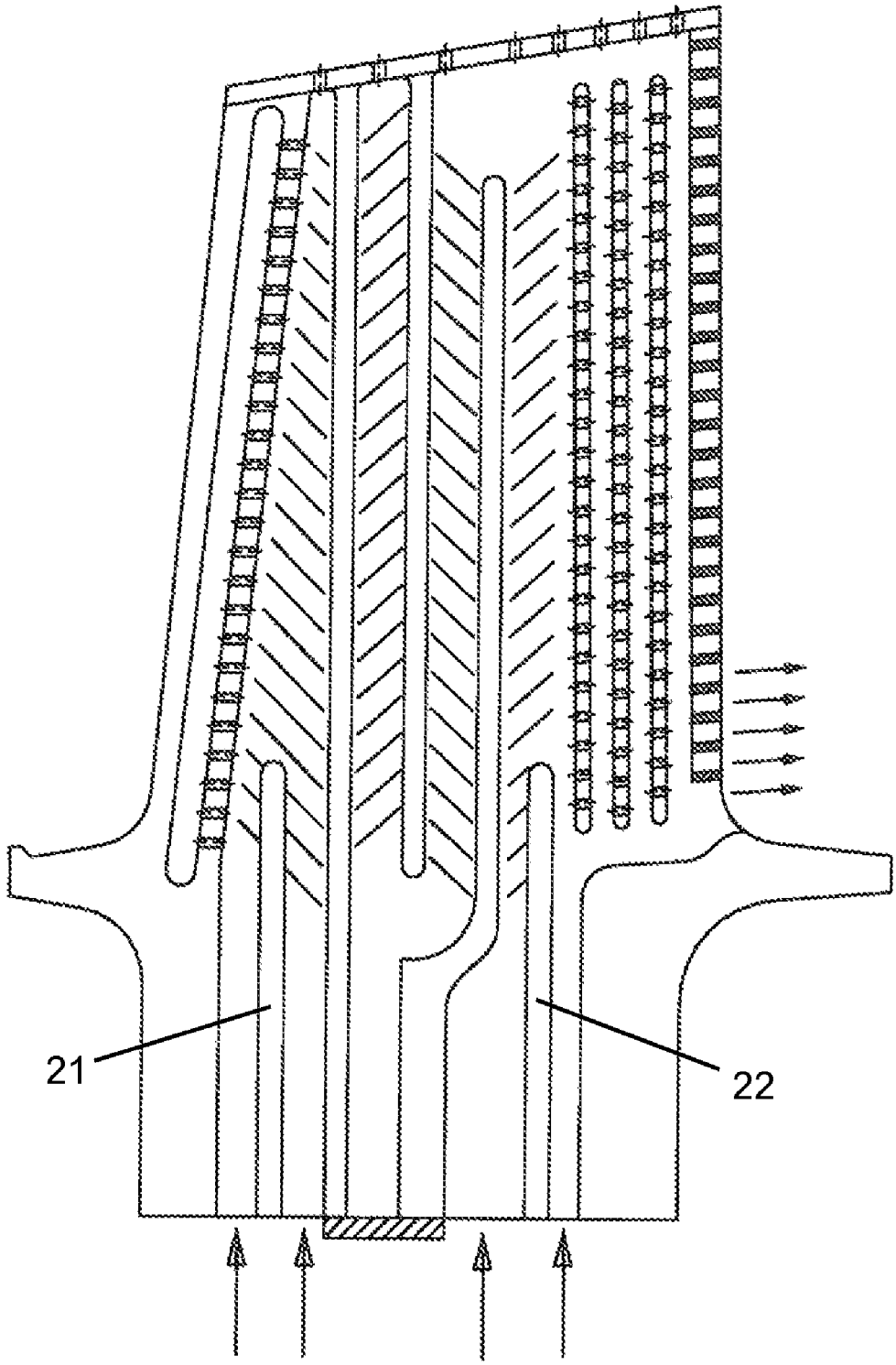
FIG. 7 shows cross section side view of a first stage blade with the strain relief ribs formed from the ceramic core of the present invention.

FIG. 6 shows a first stage rotor blade with a strain relief rib 21 extending across the leading edge cooling air supply channel and a strain relief rib 22 extending across the last leg of the serpentine adjacent to the trailing edge region cooling circuit. FIG. 7 shows a cross section side view of the blade in FIG. 6 with the strain relief ribs 21 and 22, which are formed in the lower span of the rotor blade and extend through the root and into the airfoil just above the platform. The strain relief ribs 21 and 22 are formed by strain relief slots formed within the ceramic core so that the strain relief ribs 21 and 22 are formed in the blade during the investment casting process.

The strain relief slots are formed in the ceramic core not for the main purpose of forming the strain relief ribs 21 and 22 in the cast blade, but to prevent the bending of the ceramic core during the casting process that produces the breaks in the cross-over holes 11-16 described above in the prior art blade or vane.

Figure 8:
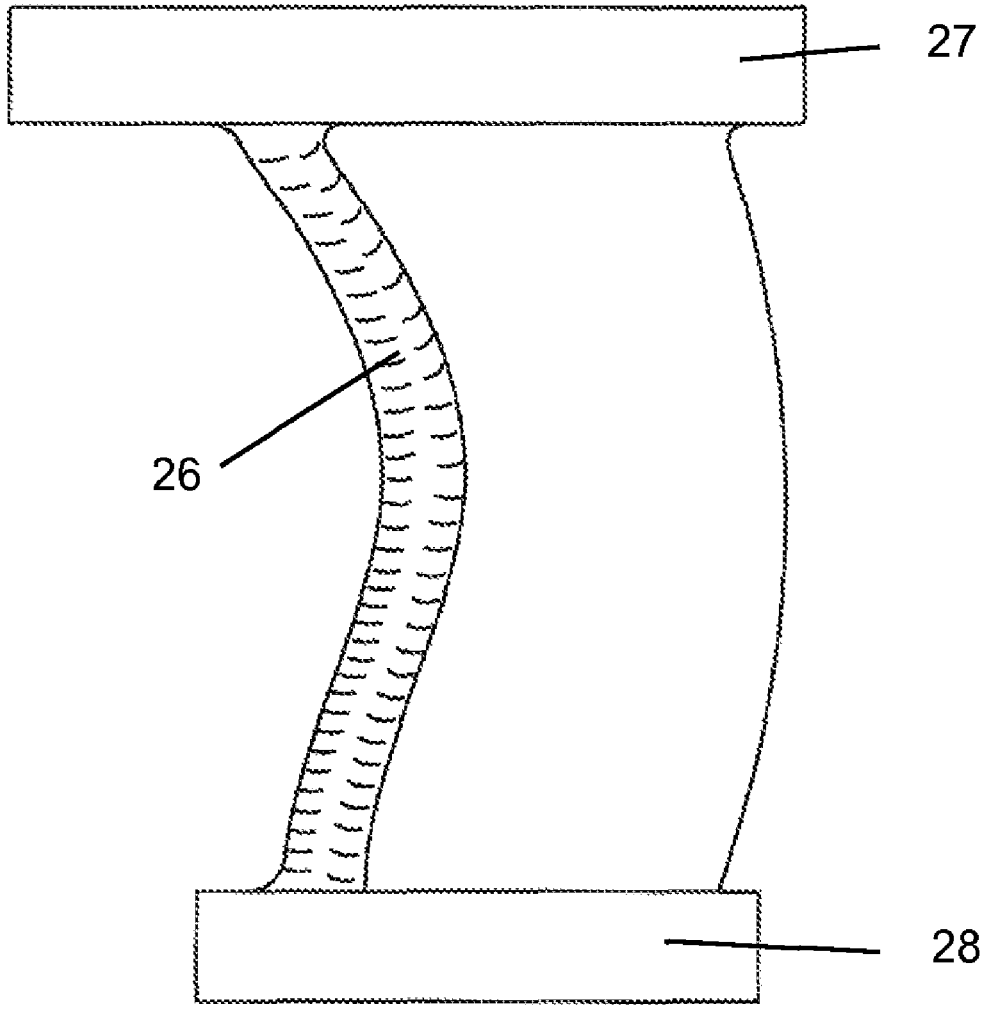
FIG. 8 shows a front view of a second stage stator vane with the strain relief rib of the present invention.
Figure 9:
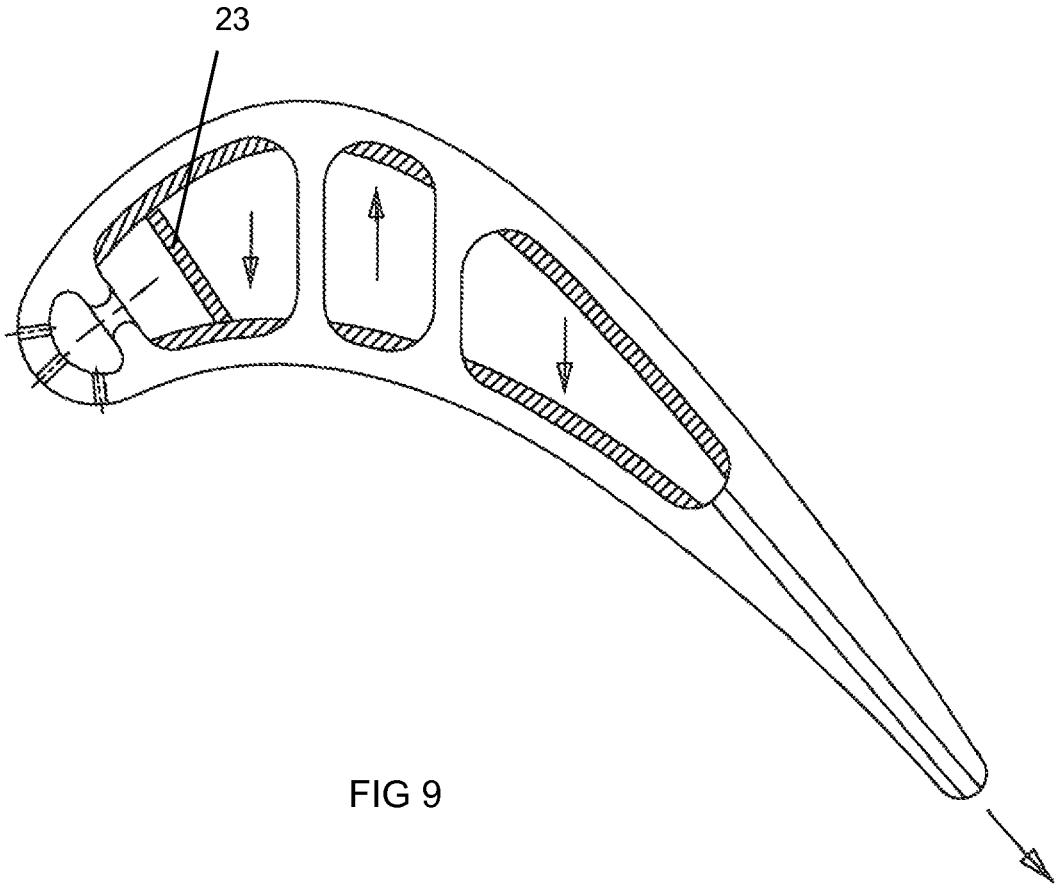
FIG. 9 shows a cross section top view of the stator vane in the outer diameter endwall section with the stress relief rib in the leading edge region cooling passage of the present invention.
Figure 10:
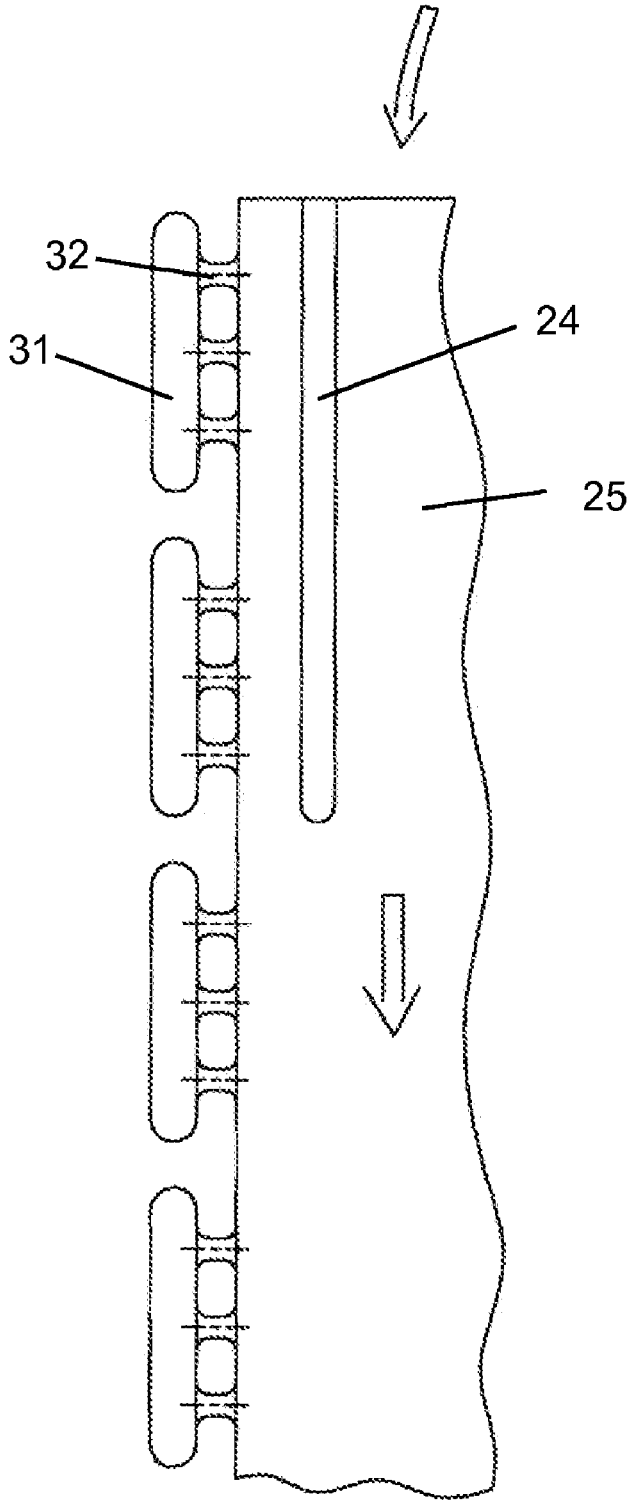
FIG. 10 shows a cross section side view of a ceramic core with a relief slot that is used to form the strain relief rib in the stator vane of FIG. 10 of the present invention.

The strain relief cuts can also be used in a stator vane core to cast a vane with relief ribs. FIG. 8 shows a stator vane with an airfoil having a leading edge 26 extending between an outer diameter endwall 27 and an inner diameter endwall 28. FIG. 9 shows a cross section top view of the stator vane with a strain relief rib 23 formed in the leading edge region cooling air supply cavity or channel. In the vane embodiment of the present invention, the strain relief rib 23 is formed in the upper span of the vane airfoil. FIG. 10 shows a cross section side view of an upper span section of the ceramic core a strain relief cut 24 formed in the larger ceramic core section that extends from the outer diameter endwall and into the airfoil of the larger ceramic core 25 that forms the leading edge region cooling air channel in the vane. The large ceramic core 25 is connected to a number of smaller ceramic cores 31 through a number of cores for cross-over holes 32. The smaller ceramic cores 31 form the impingement cavities along the leading edge of the vane while the cross-over holes 32 form the impingement holes. The presence of the strain relief slot 24 prevents the relative bending of the larger core with respect to the smaller core 31 so that the ceramic cross-over holes 32 do not break during the vane casting process. For the vane, only one strain relief slot is required to cast the vane without cross-over holes breakage.

I claim the following:

1. A ceramic core for use in casting a high temperature air cooled turbine airfoil, the ceramic core comprising:

a cooling air supply channel forming ceramic core piece;

an impingement pocket ceramic core forming piece;

the cooling air supply channel forming ceramic core piece being larger than the impingement pocket ceramic core forming piece;

a cross-over hole forming ceramic core connecting the cooling air supply channel forming ceramic core piece to the impingement pocket ceramic core forming piece;

the cross-over hole forming ceramic core being smaller than the impingement pocket ceramic core forming piece; and, a strain relief slot formed in the cooling air supply channel forming ceramic core piece overlapping with the cross-over hole forming ceramic core in a direction perpendicular to a longitudinal direction of the ceramic core.

2. The ceramic core of claim 1, and further comprising:

the ceramic core is used to cast a turbine rotor blade; and, the strain relief slot is formed in a blade root forming section that extends up and into a cooling air supply forming channel.

3. The ceramic core of claim 1, and further comprising:

the ceramic core is used to cast a turbine rotor blade;

the ceramic core includes a first strain relief slot and a second strain relief slot;

the first strain relief slot is formed in a blade root forming section that extends up and into a cooling air supply forming channel adjacent to a leading edge region of the blade; and, the second strain relief slot is formed in the blade root forming section that extends up and into a cooling air supply forming channel adjacent to a trailing edge region of the blade.

4. The ceramic core of claim 1, and further comprising:

the ceramic core is used to cast a turbine stator vane; and, the strain relief slot extends from an outer diameter endwall forming section of the ceramic core.

5. The ceramic core of claim 1, and further comprising:

the cross-over hole forming ceramic core includes a plurality of ceramic pieces.

6. A ceramic core for use in casting a high temperature air cooled turbine rotor blade, the ceramic core comprising:

a blade root cooling air supply channel forming piece;

a blade airfoil cooling air supply channel forming piece connected to the blade root cooling air supply channel forming piece to form a continuous cooling air supply channel forming piece;

a cross over hole forming piece located in a lower section of the blade airfoil cooling air supply channel forming piece; and, a strain relief slot extending into the blade airfoil cooling air supply channel forming piece and overlapping with the cross over hole forming piece in a direction perpendicular to a longitudinal direction of the ceramic core.

7. The ceramic core of claim 6, and further comprising:

the strain relief slot extends from the blade root cooling air supply channel forming piece and into the blade airfoil cooling air supply forming piece.

8. The ceramic core of claim 6, and further comprising:

the strain relief slot is located in a leading edge region cooling air supply channel forming piece of the ceramic core.

9. The ceramic core of claim 6, and further comprising:

the strain relief slot is located in a trailing edge region cooling air supply channel forming piece of the ceramic core.

10. A ceramic core for use in casting a high temperature air cooled turbine stator vane, the ceramic core comprising:

a cooling air supply channel forming piece extending from an outer diameter endwall forming piece;

a leading edge region impingement cavity forming piece located in an upper span of the ceramic core near to the outer diameter endwall forming piece;

a cross-over hole forming piece connecting the impingement cavity forming piece to the cooling air supply channel forming piece; and, a strain relief cut extending into the cooling air supply channel forming piece and overlapping with the cross-over hole forming piece in a direction perpendicular to a longitudinal direction of the ceramic core.

11. A ceramic core for use in casting a high temperature air cooled turbine airfoil, the ceramic core comprising:

a cooling air supply channel forming piece having a progressively decreasing cross sectional flow area;

an impingement cooling cavity forming piece located adjacent to the cooling air supply channel forming piece;

a row of cross-over hole forming pieces connecting the cooling air supply channel forming piece to the impingement cooling cavity forming piece; and, a strain relief slot in the cooling air supply channel forming piece into a narrower section of the cooling air supply channel forming piece and overlapping with the cross-over hole forming piece in a direction perpendicular to a longitudinal direction of the ceramic core.

12. The ceramic core of claim 11, and further comprising:

the strain relief slot is formed in the cooling air supply channel forming piece having the largest cross sectional flow area.

* * * * *